US005629879A

United States Patent [19]

Lelle

[11] Patent Number: 5,629,879

[45] Date of Patent: May 13, 1997

[54] CONTROL DEVICE FOR THE ACTUATION OF SWITCHGEARS ACCORDING TO A TIME PROGRAM

[75] Inventor: Josef Lelle, Baden-Baden, Germany

[73] Assignee: Landis & Gyr Technology Innovation AG, Zug, Switzerland

[21] Appl. No.: 359,277

[22] Filed: Dec. 19, 1994

[30] Foreign Application Priority Data

Dec. 24, 1993 [EP] European Pat. Off. ..... 93810909

[51] Int. Cl.[6] ..... G07F 11/00

[52] U.S. Cl. ..... 364/579; 364/550; 371/24; 371/48; 371/72; 395/750; 373/108; 110/185

[58] Field of Search ..... 364/550, 579; 371/24, 48, 72; 395/750; 110/185; 373/108; 307/141, 141.4, 141.8, 11, 125, 130, 131, 39, 12, 31, 35

[56] References Cited

U.S. PATENT DOCUMENTS

| | | | |
|---|---|---|---|
| 4,777,479 | 10/1988 | Hinckley | 340/644 |
| 4,974,179 | 11/1990 | Patton et al. | 364/550 |
| 5,497,380 | 3/1996 | Bott et al. | 371/24 |

FOREIGN PATENT DOCUMENTS

| | | | |
|---|---|---|---|
| 3801952 | 7/1989 | Germany . | |
| 3044047 | 7/1990 | Germany | 431/24 |
| 3041521 | 8/1990 | Germany | 307/115 |
| 4137204 | 4/1993 | Germany . | |

*Primary Examiner*—Emanuel T. Voeltz
*Assistant Examiner*—Hien Vo
*Attorney, Agent, or Firm*—Meltzer, Lippe, Goldstein, et al.

[57] ABSTRACT

The information on the state of switchgears (2.1;2.2) appearing on call circuits in the form of analog low-voltage signals is conveyed in parallel to a circuit block (4). The information is digitalized at given points in time in the form of binary values "0" or "1" and is transmitted in series to a microprocessor (1). Preferably the circuit block (4) comprises at least one shift register in cascade connection. Call circuits are coupled to the circuit block solely via a high-impedance resistor (3.1;3.2). The circuit block (4) is supplied by a voltage supply circuit (5) so that when one of the switchgears (2.1;2.2) is in the open state, a current flows alternately via one of the protection diodes (D1S.1,D2S.1;DIS.2,D2S.2) of the circuit block (4), and does not do so when one of the switchgears (2.1;2.2) is in the closed state. To ascertain whether a voltage ($U_1$,U2) at the input (4.1;4.2) of the circuit block (4) is D.C. or A.C., the microprocessor (1) effects a multiple scanning within a time period of one to two network half-waves and makes an analysis of values detected consecutively in time. The control device is especially well suited for the control of art oil or gas burner in continuous operation.

15 Claims, 2 Drawing Sheets

PA 2654

CONTROL DEVICE FOR THE ACTUATION OF SWITCHGEARS ACCORDING TO A TIME PROGRAM

RELATED APPLICATION

The related application entitled "Control Device for the Actuation of Switchgears" to K. Bott et al. and filed concurrently herewith is hereby incorporated by reference.

1. Field of the Invention

The invention relates to a control device having a timing and control logic unit for the actuation of several switchgears according to a time program.

2. Background of the Invention

Such control devices are used, for example, for the control and monitoring of the burner and the igniting device of oil and gas furnaces, as well as to monitor switches of actuators, such as fuel valves and aeration throttles. A microprocessor evaluates the information transmitted over call circuits carrying the mains voltage and issues appropriate control commands. In particular, because of the safety required when switching on and when operating oil and gas furnaces, the switch-off capability of the switchgears for the loads as, for example, a fuel valve which are critical concerning safety regulations must be checked frequently so that a malfunction of the switchgear can be recognized early, before a dangerous situation may develop. German patents DE-PS 30 44 047 C2 and DE-PS 30 41 521 C2 disclose a switchgear for oil burners in which information on switching states of relay and sensor contacts are transmitted by means of amplifiers to a microprocessor. The switching states of the relay contacts are transmitted via supply voltage carrying call circuits to respective amplifiers which are connected at the output to an input of the microprocessor. The microprocessor must be provided with a number of inputs at least equal to the number of amplifiers. For the galvanic separation of the call circuit and the microprocessor, separative elements, such as optocouplers or transmitters, are used. Here one separative element per signal voltage is present. The microprocessor is programmed to carry out a number of tests in order to ascertain whether the system having connected sinks actually and correctly goes through a switching-on phase. For this purpose, signals are memorized by the microprocessor and are compared with desired values.. In the case of a defective sink state, the microprocessor switches off the sinks.

Furthermore, in an arrangement for the monitoring of alternative-current switches known from DE-OS 41 37 204, call circuits carrying mains voltage are connected via optocouplers to the scanning unit of an alternative-current detector. Each call circuit is connected to the optocoupler via a low pass consisting of a resistor and a capacitor connected in series to the optocoupler. The switching states of the A.C. switches are scanned and stored via the call circuits. In an evaluation unit downstream of the scanning unit, the switching states are compared with a desired state (open or closed) and a switching state signal containing at least one information item (error or no error) for all the existing A.C. switches is formed. It is not possible to know, from the switching state signal, which A.C. switch can no longer be switched off. Therefore, a simple display for diagnosis is not possible.

Optocouplers have been used, for example, as separative elements for the galvanic separation of the monitored system from the microprocessor. Optocoupler applications of this type are known from the specialized literature (TI Opto Kochbuch of 1975, ISBN 3 88078 000 5).

However, the optocouplers are disadvantageous because they are not error-proof and have a higher failure rate than other electronic components. Therefore, they must be checked for false signals also in active operation when used in applications where safety is critical. Furthermore, as the number of optocouplers increases, the electromagnetic compatibility and, thereby, the reliability of the control unit decrease. In systems with many call circuits carrying mains voltage this could involve great costs for as long as an expensive separative element, such as an optocoupler or transmitter and an input pin on the microprocessor, must be provided for each call circuit.

SUMMARY OF THE INVENTION

It is an object of the invention to provide a control device with a microprocessor so that it easily and reliably acquires information on the state of switchgears switching loads on or off, where the information is available in the form of low-voltage signals, and transmits it to the microprocessor.

The invention is based on the principle by which the information on the states of the switchgears appearing in the form of analog low-voltage signals on the call circuits are transmitted to a circuit block in parallel. The voltages appearing at the inputs of the circuit block are digitalized at given points in time as binary values "0" or "1" depending on a predetermined voltage value. These values are transmitted in series to a microprocessor. A shift register, in particular an arrangement with several shift registers in cascade if many switchgears are to be monitored, is suitably used as the circuit block.

Two different problems must be solved to implement this principle technically. First, the call circuits must be connected via coupling elements to the circuit block so that the circuit block is not destroyed even when overvoltages occur. Secondly, the information on the states of the switchgears must be obtained from the distinction as to whether a low-voltage signal is A.C. or D.C. The first problem can be solved by the call circuits being connected to the circuit block via resistance networks consisting of resistors, capacitors and diodes which divert overvoltages, as well as excess currents. In the present invention, the coupling element is reduced in a cost-saving manner to one single high-impedance resistor. Digitalization can be carried out by a synchronizing device at any point in time when the amplitude of an A.C. voltage is detected as logic "1" and the amplitude of a D.C. voltage as logic "0". In the present invention, several digitalizations take place in the form of multiple scanning within a time period of one to two network half-waves and an analysis of the values detected in time sequence so that synchronization is not required.

The present invention provides a control device with a minimum of components combined with an operating method in which pad of the problem is solved by software.

In one embodiment of the present invention, a control device is provided. A timer and control logic unit actuates a plurality of switchgears according to a time program. A plurality of loads having a current supply which is controlled by the switchgears are provided. The loads are connected in a mains-voltage network between a phase and ground in series with the switchgears. A circuit block has a plurality of inputs which are electrically connected to taps located in a current path between the switchgears and the loads and an output which is connected to the timer and control logic unit. A plurality of call circuits is provided. Each call circuit has an output connected to an input of the circuit block and an input connected to one of the taps. Each call circuit comprises a resistor. A voltage supply circuit supplies the circuit block from the phase. The circuit block comprises a plurality of protection diodes. When one of the switchgears is in an open state current flows via the protection diodes assigned to a corresponding input of the circuit block so that voltage signals from the call circuits assume a variegated evolution in time at the corresponding input in relation to a reference point of the circuit block. The evolution of the voltages is constant when the switchgear is in a closed state. The timer and control logic unit carries out a test cycle at given points in time to ascertain the state of the switchgears. During the test cycle, the timer and control logic unit detects the voltages at the circuit block inputs at predetermined points in time as a function of a predetermined voltage, causes the detected voltages to be transmitted to itself via a serial output of the circuit block and a serial data line, and determines the state of the switchgear according to the detected voltages.

In another embodiment of the invention, the detected voltages are detected as binary numbers. The test cycle can comprise a multiple scanning.

In another embodiment of the invention, the timer and control logic unit is supplied by the voltage supply circuit from the phase of the mains-voltage network and the resistors are connected directly to inputs of the timer and control logic unit.

In still another embodiment of the invention, the circuit block can comprise at least one shift register connected in cascade.

In yet another embodiment of the invention, the circuit block and the timer and control logic unit are galvanically separated.

In another embodiment of the invention, the timer and control logic unit carries out a test cycle at certain points in time to detect the state of the switchgears in order to detect malfunctions in continuous operation of a system controlled by the control device.

In still another embodiment of the invention, the timer and control unit determines the state of the switchgears based on an addition of the detected binary numbers.

In still another embodiment of the invention, the timer and control unit determines the state of the switchgear as soon as one of the binary numbers is different from an appertaining binary number found at a previous point in time $t_{i-1}$ or as soon as a time period between a first scanning at point in time $t_1$ and a last scanning at point in time $t_i$ is longer than the duration of a network half-wave.

In yet another embodiment of the invention, a test module having a serial data input and a plurality of parallel outputs is provided. The parallel outputs are connected to the parallel inputs of the circuit block. The parallel outputs are switchable to either a conductive or a high-impedance tristate state. The serial data input is connected to the timer and control logic unit.

In yet another embodiment, the test module comprises at least one shift register connected in cascade.

In yet another embodiment, the timer and control logic unit carries out a test cycle at predetermined points in time to detect input coupling errors or hardware errors of the circuit block by entering a test pattern via a serial circuit line into the test module, by putting the test module in a conductive state, by causing the voltage levels ($U_1$ to $U_8$) appearing at the inputs of the circuit block to be detected and transmitted to itself, by comparing the reported test pattern with the emitted test pattern and by putting the test module back into the tristate state.

DETAILED DESCRIPTION OF THE INVENTION

Figure 1:
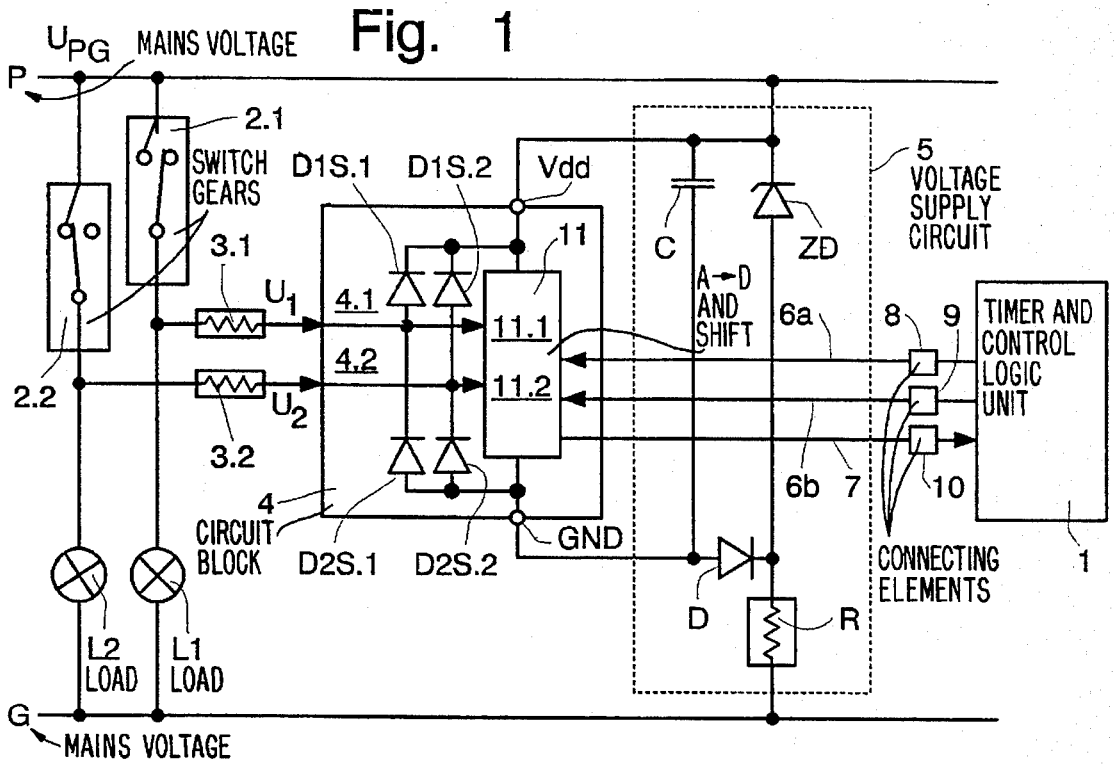
FIG. 1 shows a control device.

FIG. 1 shows a control device using a microprocessor 1 as a timer and control logic unit. The control device also comprises two switchgears 2.1 and 2.2, resistors 3.1 and 3.2, a circuit block 4 and a voltage supply circuit 5. The output of the first switchgear 2.1, which switches a load L1 to a mains voltage $U_{PG}$ located between a phase P and a zero point G, is connected to the input of the first resistor 3.1. The output of the second switchgear 2.2, through which an additional load L2 is supplied by the mains voltage $U_{PG}$, is connected to the input of the second resistor 3.2. The outputs of the resistors 3.1 and 3.2 are connected to parallel inputs 4.1 and 4.2 of the circuit block 4 to process the low-voltage signals which appear at the taps between the switchgears 2.1 or 2.2 and the loads L1 or L2. The circuit block 4 is fed by the voltage supply circuit 5. In addition, the circuit block 4 is connected to the microprocessor 1 via two control circuit lines *6a* and *6b*, as well as a serial data line 7 for the transmission of the voltage levels which are present at the inputs 4.1 to 4.2 to the microprocessor 1. The control circuit lines 6a and 6b and the data line 7 are each provided with a connecting element 8, 9 or 10. The control device can also be designed to control more than two loads, e.g., for n=32 loads.

The microprocessor 1 is programmed by a time program to switch the loads L1 and L2 on and off in a given sequence during the switch-on phase of a system like, for example, a gas burner. The switching is done by means of the switchgears 2.1 and 2.2. The microprocessor 1 is also programmed to monitor various processes, such as the formation of a flame, and to switch off the entire system if necessary, so that the gas burner is at no time in danger of explosion. In addition, in continuous operation of the system to be controlled the microprocessor 1 executes a monitoring program for the recognition of error states of the system. In order to determine the state (open or closed) of a switchgear 2.1 or 2.2, the microprocessor I carries out a testing cycle, as explained below. The frequency of the testing cycles depends on the applications of the control device and the applicable legal regulations or standards. Thus for instance, automatic furnaces which meet the requirements of Standard EN 298 must recognize an error within a period of three seconds following its occurrence. A testing cycle is, therefore, executed typically every 200 milliseconds. In this manner, it is possible to reliably ascertain the state of each of the switchgears 2.1 or 2.2 within the required three seconds, even if the state of one of the switchgears 2.1 or 2.2 has just changed during a testing cycle.

The voltage supply circuit 5 is provided with a Zener diode ZD and a resistor R which are connected in series between phase P and zero-point G of the mainsvoltage network. The cathode of the Zener diode ZD is connected to the phase P. Parallel with the Zener diode ZD, a capacitor C and an additional diode D are connected in series, with the cathode of the diode D being connected to the anode of the Zener diode ZD. A connection Vdcl of the circuit block 4 is connected to the cathode of the Zener diode ZD, a connection GND of the circuit block 4 is connected with the anode of diode D, so that the connection GND is connected to the minus pole and the connection Vdd is connected to the plus pole of the voltage supply circuit 5.

The circuit block 4 contains a circuit element 11 with parallel inputs 11.1 and 11.2 which are connected to the inputs 4.1 or 4.2. The circuit element 11 digitalizes the voltage levels occurring at the inputs 11.1 and 11.2 and converts them into a serial data stream for transmission to the microprocessor 1 via data line 7. For this reason the inputs 11.1 and 11.2 have a high impedance with values typically in the range of NΩ. The circuit element 11 is made in the form of a shift register and is controlled via only two control inputs. The shift register is caused according to the level "0" or "1" of the first control circuit line 6a to digitalize the voltage levels occurring at its inputs 11.1 and 11.2 as values "0" or "1" as the next impulse is transmitted over the second control circuit line 6b and to memorize them in its register or to shift the contents of the register by one place in the direction of the output, so that all values memorized in parallel after n=2 impulses are transmitted via serial data line 7 to the microprocessor 1. Each of the inputs 4.1 and 4.2 of the circuit block 4 is connected via two protection diodes DIS. 1 and D2S.1 or D1S.2 and D2S.2 to the connection Vdd or to the connection GND. The cathodes of the protection diodes D1S.1 and DIS.2 are connected to the connection Vdd, the anodes of the protection diodes D2S.1 and D2S.2 are connecteel to the connection GND. These protection diodes serve to dived overvoltages so as to prevent destruction of the circuit element 11. With integrated circuits, such as CMOS, all the inputs are normally equipped with such diodes so that a commercially available shift register provided with protection diodes can be used in padicular as the overall circuit block 4.

The resistors 3.1 and 3.2 are used as coupling elements and their value is rated typically at 5M Ω so that the control device can be used with different mainsvoltage networks with 115 V or 230 V, as well as with extra-low voltage networks of, e.g., 24 V, and so that the protection diodes D1S.1, DIS.2, D2S.1 and D2S.2 are not destroyed when a voltage surge of four thousand volt is superimposed on the mains voltage $U_{PG}$.

In operation this control device functions as follows:

In the open state of the switchgear 2.1, as shown in FIG. 1, a current flows during the positive half-wave from phase P via capacitor C, connection GND, protection diode D2S.1, input 4.1, resistor 3.1 and load L1 to the zero-point G. During the negative half-wave, a current flows from zero-point G via load L1, resistor 3.1, input 4.1, protection diode DIS.1 and connection Vdd to the phase P. The circuit block 4 is supplied by the voltage supply circuit 5 because of the capacitor C in such a manner that the voltage difference between the connections Vdd and GND is nearly equal to the Zener voltage of the Zener diode ZD in the average time. If a current flows through one of the protection diodes D1 S.1 or D2S.1, the voltage drop via these diodes is approximately equal to the conducting-state voltage $U_P$. The voltage at input 4.1 relative to the voltage at connection GND is thus, e.g., $U_P$ during the positive half-wave of the mains voltage $U_{PG}$ and Vdd - $U_P$ during the negative half-wave, except in proximity of the crossover.

In the closed state of the switchgear 2.2, as shown in FIG. 1, the input 4.2 is connected via resistor 3.2 to the positive pole Vdd of the voltage supply circuit 5 and is, therefore, always connected to the potential Vdd.

In the described example, the voltage evolution $U_1$ at the input 4.1 is alternative and the voltage evolution $U_2$ at the input 4.2 is direct. The testing cycle to determine the state of the switchgears 2.1 and 2.2 consists now in ascertaining and then evaluating the evolution in time of the voltages $U_1$ and $U_2$, typically during the period of one to two half-waves of the mains voltage $U_{PG}$.

Figure 2:
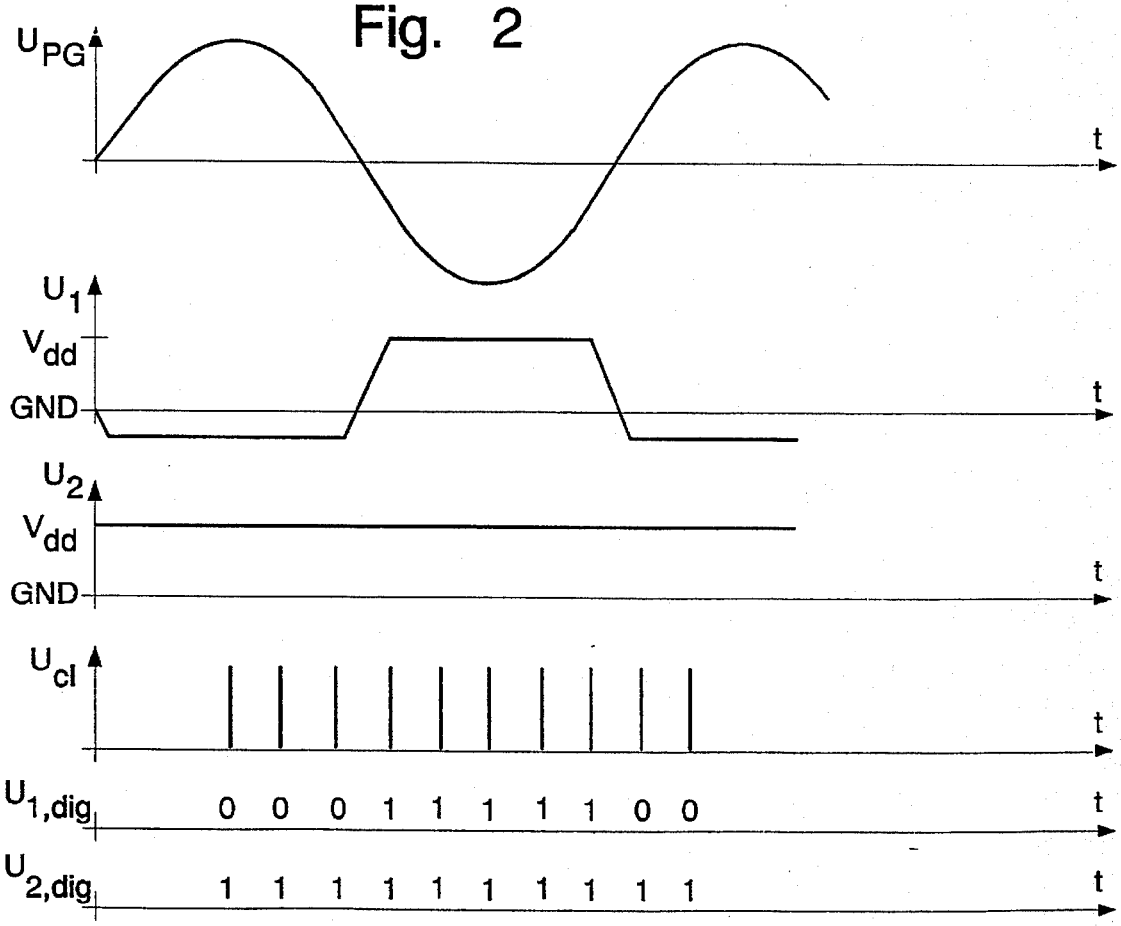
FIG. 2 shows diagrams to explain the operation of this control device.

FIG. 2 shows the evolution in time of the mains voltage $U_{PG}$, of the voltages $U_1$ and $U_2$ at the inputs 4.1 or 4.2, the scanning frequency $U_{cl}$ of the microprocessor 1, values $U_{1,dig}$ and $U_{2,dig}$ digitalized binarily in the form of numbers "0" or "1" in accordance with a predetermined voltage level which may, for example, be in the middle between the levels of connections GND and Vdd of circuit block 4. The scanning rhythm $U_{cl}$ of the microprocessor 1 is selected to be greater than the frequency of the mains voltage $U_{PG}$, e.g., by a factor of ten. During the first part of the testing cycle, the microprocessor 1 causes the levels of the voltages $U_1$ and $U_2$ to be detected and transmitted in the form of binary numbers "0" or "1" by means of the circuit element 11 at k predetermined points in time $t_1$, $t_2$ to $t_k$, whereby the time period $t_k$–$t_1$ is longer than a network half-wave. The sequence $F_1$ of the numbers $U_{1,dig}(t_1)$, $U_{1,dig}(t_2)$, . . . $U_{1,dig}(t_k)$ contains values "0" as well as "1", whereas the sequence $F_2$ of the numbers $U_{2,dig}(t_1)$, $U_{2,dig}(t_2)$, . . . $U_{2,dig}(t_k)$ only contains values "1". During the second part of the testing cycle, the microprocessor 1 effects a suitable analysis of the sequences $F_1$ and $F_2$ and from this determines the state of the switchgears 2.1 and 2.2.

When the scanning frequency $U_{cl}$ is higher by a factor of ten than the network frequency, simply adding the sequences $F_1$ and $F_2$ over ten consecutive numbers results in an average value "5" for sequence $F_1$ and, thereby, for the open switchgear 2.1, and in a value "10" for the sequence $F_2$ and, thereby, for the closed switchgear 2.2. Thus, the state of the switchgears 2.1 and 2.2 can be ascertained from the total value of the appertaining sequence $F_1$ or $F_2$.

Network disturbances during scanning may result in one or several of the values of the sequences $F_1$ and $F_2$ being different than in the case of a scanning without disturbance. A random scanning during a crossover of the mains voltage $U_{PG}$ may also result in an erroneous value. Therefore, any numeric value between "0" and "10" may be produced as the total value. The microprocessor 1 is programmed to interpret values "9" and "10" as closed state, values "3", "4", "5", "6" or "7" as open state and values "0" or "1" as an error of the control device which should not occur. If a value "2" or "8" occurs, the microprocessor 1 repeats the scanning.

The microprocessor 1 can also carry out a shorter testing cycle, in which the time period between the first scanning at point in time $t_1$ and the last scanning at point in time $t_k$ is slightly longer than the duration of a network half-wave. The total value of sequence $F_1$ is then subjected, even without disturbances, to a probability distribution but can assume neither value "1" nor value "k" since at least the scanning at point in time $t_k$ falls into a different network half-wave than the scanning at point in time $t_1$. The total value of the sequence $F_2$ is value "k". The microprocessor 1 then interprets a value "k" as closed state, a value in the range "1" to "k–1" as open state and a value "0" as error. If two scanning times fall into different network half-waves, the total value of the sequence $F_1$ cannot assume the values "1", "2", "k–1" and "k". The probability distribution for the total value of sequence $F_1$ becomes narrower as the number of scanning times falling into different network half-waves increases, thereby causing the susceptibility relative to disturbances to decrease since the possible total values of the sequences $F_1$ and $F_2$ are different even when disturbances occur.

The shortest testing cycle which lasts somewhat longer than one network halfwave, in the worst scenario, occurs when the microprocessor 1 ascertains the state of the switchgear 2.1 and switchgear 2.2 as soon as the value $U_{1,dig}(t_1)$ is different from the preceding value $U_{1,dig}(t_{i-1})$ or as soon as the time period between the first scanning at point in time $t_1$ and the last scanning at time $t_i$ is longer than the duration of a network half-wave. The open or closed -state of the switchgears 2.1 and 2.2 is then determined by finding out whether the two last-acquired number values $U_{1,dig}(t_{i-1})$ and $U_{1,dig}(t_i)$ or $U_{2,dig}(t_{i-1})$ and $U_{2,dig}(t_i)$ are different or whether both are "1". However, the gain in speed is accompanied by a heightened susceptibility to disturbances in the network.

The above-described control device makes it possible to use a microprocessor 1 whose number of inputs is independent of the number m of loads L1 to Lm to be controlled. Therefore, a microprocessor with a considerably smaller number of inputs than the number of loads L1 to Lm to be controlled may be used. The utilization of the protection diodes DIS. 1 and D2S1 to D1S.2 or D2S.2, which are built in a standard manner into the integrated circuits, for the obtaining of information on the state of the switchgears 2.1 and 2.2, offers a high degree of safety even without expansion with testing elements and associated testing processes. This safety is due to the logic values "0" and "1" which must be present if one of the switchgears 2.1 or 2.2 is in the open state which is more significant from the point of view of safety.

Furthermore, the proposed control device stands out as a low-cost assembly thanks to the possibility of using standardized components. The number of components is at a minimum, resulting in fewer failures and increased reliability. The evaluation of the information provided in the form of low-voltage signals is carried out entirely by the microprocessor 1. The process requires no particular synchronization in time between the microprocessor I and some other component of the control device. This software solution makes it possible to acquire with great ease certain physically available information data and to determine the information desired on the state of the switchgears by means of a small program contained in a memory. The circuit block 4 in particular requires no means of any kind, such as zero-point detectors, integrators or mean value formers, to analyze data or to edit data. The circuit block 4 is advantageously made in the form of a shift register with, e.g., n=8 parallel inputs which are equipped with protection diodes which are produced by the millions. In the case of a malfunction of one of the switchgears 2.1 or 2.2, a simple way of displaying it is possible since the information on the state of each of the switchgears 2.1 and 2.2 is available in the microprocessor 1 and can be displayed by simple means, e.g., by means of luminous diodes or an LCD display.

The electric supply of the microprocessor can be ensured by different means depending on the application of the control device. In the simplest case the microprocessor is also supplied by the voltage supply circuit 5 and the circuit block 4 is connected via circuit lines *6a*, *6b* and 7 directly to the microprocessor 1 without the connecting links 8, 9 and 10. In such a case, it may be economical to use several of the inputs of the microprocessor 1, which must be provided with suitable protection diodes, as circuit block 4 and to connect the resistors 3.1 and 3.2 directly to the inputs of the microprocessor 1.

For a control device where the microprocessor 1 must be galvanically separated from the mains voltage $U_{PG}$ for safety reasons, e.g., because a temperature sensor is connected to the microprocessor 1, the connecting links 8, 9 and 10 are made in the form of galvanic separative elements. Additional advantages of reliability, electromagnetic compatibility and cost occur because the microprocessor 1 can be separated from the circuit block 4 and, thereby, also from the mains voltage $U_{PG}$ with only a few galvanic separative elements 8, 9 and 10. Therefore, the number of galvanic separative elements may also be considerably lower than the number m of the loads L1 to Lm.

Instead of multiple scanning to detect the time evolution of the voltages $U_1$ or $U_2$ a synchronization device may be used to make sure that the voltages $U_1$ or $U_2$ are ascertained at the proper timing points. Such a solution is in principle described in the related application "Control Device for the; Actuation of Switchgears" to K. Bott et al.

Figure 3:
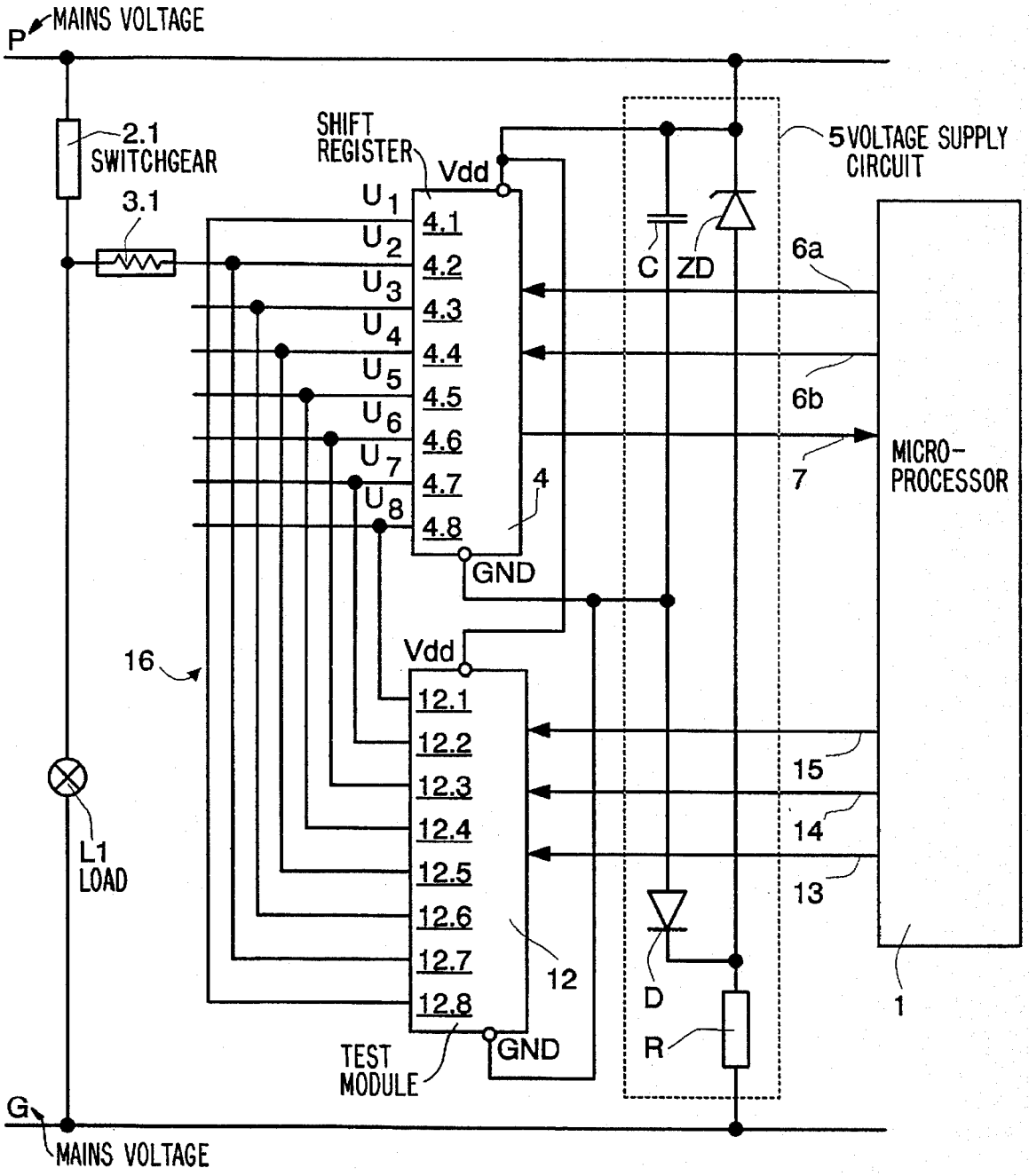
FIG. 3 shows a control device with a testing module.

FIG. 3 shows a further development of a device for the control of up to n=8 switchgears 2.1 to 2.8. The device is expanded by a test module 12 for the detection of input coupling errors or hardware errors of the circuit block 4 which is in the form of a shift register. An input coupling error may occur for instance if the value mad at the input 4.2 depends not only on the voltage level at the input 4.2 but also on the voltage level appearing at another input, e.g., 4.5. A hardware error occurs if the collected value of an input always appears as logic "0" (stack at zero) or logic "1" (stack at one), whatever the appearing voltage level may be.

The testing module 12 is provided with a serial data input, a cycle input and an input which controls the state of its outputs 12.1 to 12.8. All of these inputs are connected via circuit lines 13, 14 or 15, respectively, to the microprocessor 1. Parallel outputs 12.1 to 12.8 are connected via circuit lines 16 to the inputs 4.1 to 4.8 of the shift register 4. They can be switched into a state known in the field as "tristate", in which they are high-impedance outputs and do not influence the state of the circuit lines 16 (see, e.g., U. Tietze and Ch. Schenk, "Semiconductor Switching Technology" (Halbleiterschaltungstechnik), 5th edition, Springer Verlag Berlin Heidelberg New York, ISBN 3-540-09848-8). The test module 12 advantageously comprises a second shift register and is connected to the voltage supply circuit 5 in the same manner as the shift register 4. The inputs 4.1 to 4.8 of the shift register 4 are furthermore connected to the outputs of the resistors 3.1 to 3.8, whereby only the switchgear 2.1 and the resistor 3.1 are drawn for the sake of clarity. The described device functions as follows.

In normal operation the outputs 12.1 to 12.8 of the testing module 12 are in the tristate state and do not influence the voltages $U_1$ to $U_8$ at the inputs 4.1 to 4.8. To test the reliability of data acquisition by means of the circuit block 4 the microprocessor 1 carries out a test cycle at given points in time. During the test cycle, the microprocessor 1 transmits a test pattern consisting of eight binary values "0" or "1" via the serial circuit line 13 to the testing module 12. Following this transmission, these values are available at the outputs 12.1 to 12.8 as soon as the microprocessor 1 puts the outputs 12.1 to 12.8 into a conductive state via control circuit line 15, so that voltage levels $U_1$ to $U_8$, with values Vdd or GND depending on the previously transmitted test pattern, appear at the inputs 4.1 to 4.8 of the shift register 4. The microprocessor I now transmits further commands to the shift register 4 in order to detect the voltage levels $U_1$ to $U_8$ at its inputs 4.1 to 4.8 as binary values and for their transmission to it. Whereupon the microprocessor 1 compares the reported binary values with the transmitted test pattern. The microprocessor 1 is programmed to transmit a number of selected test patterns to the testing module 12 and to read them again via shift register 4, so that input coupling errors as well as hardware errors can be detected. In order to avoid an error due to the loss of the tristate capability of the test module 12, a test cycle is ended by entering values "0" into the register of the test module 12. To carry out this test process it is immaterial whether the switchgears 2.1 to 2.8 are opened or closed. If necessary the control circuit lines 13, 14 and 15 can be provided with galvanic separative elements.

The microprocessor 1 can also be programmed so as to carry out a testing cycle consisting of one single test pattern whenever a testing cycle is carried out to determine the state of the switchgears 2.1 to 2.8. The test pattern is different from testing cycle to testing cycle.

Finally, the above-described embodiments of the present invention are intended to be illustrative only. Numerous alternate embodiments may be devised by those skilled in the art without departing from the spirit and scope of the following claims.

I claim:

1. A control device comprising, a timer and control logic unit, a plurality of switchgears actuated by said timer and control logic unit according to a time program, a plurality of loads having a current supply which is controlled by the switchgears, the loads being connected in a mains-voltage network between a phase and ground in series with the switchgears, a circuit block having a plurality of inputs electrically connected to taps located in a current path between said switchgears and said loads and having an output connected to said timer and control logic unit, a plurality of call circuits, each call circuit having an output connected to an input of the circuit block and an input connected to one of said taps wherein each call circuit comprises a resistor, and a voltage supply circuit which supplies said circuit block from between said phase and said ground, wherein said circuit block comprises a plurality of protection diodes, wherein when one of said switchgears is in an open state, current flows via said protection diodes assigned to a corresponding input of said circuit block so that voltage signals from said call circuits assume a varying evolution in time at said corresponding input in relation to a reference point of said circuit block, and wherein said evolution of said voltage signals is constant when said switchgear is in a closed state, and wherein said timer and control logic unit carries out a test cycle at given points in time to ascertain the state of the switchgears.

2. The control device of claim 1, wherein during said test cycle said timer and control logic unit detects said voltages at said circuit block inputs at predetermined points in time as a function of a predetermined voltage;

causes said detected voltages to be transmitted to itself via a serial output of said circuit block and a serial data line, and determines the state of the switchgears according to said detected voltages.

3. The control device of claim 1, wherein said timer and control logic unit comprises a microprocessor.

4. The control device of claim 1, wherein said detected voltages are detected as binary numbers.

5. The control device of claim 1, wherein said test cycle comprises a multiple scanning.

6. The control device of claim 1, wherein said timer and control logic unit is supplied by said voltage supply circuit from the phase of the mains-voltage network and said resistors are connected directly to inputs of said timer and control logic unit.

7. The control device of claim 1, wherein said circuit block comprises at least one shift register connected in cascade.

8. The control device of claim 1, wherein said circuit block and said timer and control logic unit are galvanically separated.

9. The control device of claim 1, wherein said timer and control logic carries out a test cycle at certain points in time to detect the state of said switchgears in order to detect malfunctions in continuous operation of a system controlled by said control device.

10. The control device of claim 1, wherein said timer and control unit determines the state of the switchgears based on an addition of the detected binary numbers.

11. The control device of claim 4, wherein said timer and control unit determines the state of the switchgears as soon as one of the binary numbers is different from an appertaining binary number found at a previous point in time $t_{i-1}$ or as soon as a time period between a first scanning at point in time $t_1$ and a last scanning at point in time $t_i$ is longer than the duration of a network half-wave.

12. The control device of claim 1, further comprising a test module having a serial data input and a plurality of parallel outputs, wherein said parallel outputs are connected to said parallel inputs of said circuit block, said parallel outputs being switchable to either a conductive or a high-impedance tristate state and said serial data input is connected to said timer and control logic unit.

13. The control device of claim 12, wherein said test module comprises at least one shift register connected in cascade.

14. The control device of claim 12, wherein said timer and control logic unit carries out a test cycle at predetermined points in time to detect input coupling errors or hardware errors of the circuit block by entering a test pattern via a serial circuit line into said test module, by putting said test module in a conductive state, by causing the voltage levels ($U_1$ to $U_8$) appearing at the inputs of the circuit block to be detected and transmitted to itself, by comparing this reported test pattern with the emitted test pattern and by putting the test module back into the tristate state.

15. The control device of claim 14, wherein said test pattern comprises binary values.

* * * * *